US005818175A

United States Patent [19]

Yoshioka et al.

[11] Patent Number: 5,818,175

[45] Date of Patent: Oct. 6, 1998

[54] GAS DISCHARGE IMAGE DISPLAY

[75] Inventors: Kazuo Yoshioka; Noriyuki Tomimatsu; Sadayuki Matsumoto, all of Tokyo, Japan

[73] Assignee: Mitsubishi Denki Kabushiki Kaisha, Tokyo, Japan

[21] Appl. No.: 747,836

[22] Filed: Nov. 13, 1996

[30] Foreign Application Priority Data

May 8, 1996 [JP] Japan ..... 8-113853

[51] Int. Cl.[6] ..... G09G 3/10

[52] U.S. Cl. ..... 315/169.4; 315/169.1; 315/325; 313/582; 313/584

[58] Field of Search ..... 315/169.4, 169.1, 315/169.2, 246, 325, 358; 313/500, 505, 582, 584; 340/825.79

[56] References Cited

U.S. PATENT DOCUMENTS

| | | | |
|---|---|---|---|
| 4,737,687 | 4/1988 | Shinoda et al. | 315/169.4 |
| 4,924,148 | 5/1990 | Schwartz | 315/169.4 |
| 5,444,335 | 8/1995 | Matsumoto et al. | 315/246 |
| 5,668,443 | 9/1997 | Kawaguchi et al. | 315/169.1 |

FOREIGN PATENT DOCUMENTS

| | | |
|---|---|---|
| 0 604 902 A1 | 7/1994 | European Pat. Off. . |
| 2 291 533 | 1/1996 | United Kingdom . |
| 2 302 207 | 1/1997 | United Kingdom . |

*Primary Examiner*—Robert J. Pascal
*Assistant Examiner*—Haissa Philogene
*Attorney, Agent, or Firm*—Burns, Doane, Swecker & Mathis, LLP

[57] ABSTRACT

In the gas discharge image display of this invention, the peak value of a write pulse supplied to one of two electrodes of each of fluorescent lamps aligned in a matrix form is substantially equal to the peak value of a sustain pulse supplied to that electrode. Therefore, when a row line drive circuit or a column line drive circuit supplies, in a sustain period of a fluorescent lamp to be discharged, a write pulse to another fluorescent lamp aligned in the same row or column of the matrix form, a voltage at the fluorescent lamp to be discharged can be made constant in the sustain period.

13 Claims, 22 Drawing Sheets

| t1(μs) | 1.5 | 2.0 | 2.5 | 3.0 | 3.5 | 4.0 | 4.5 | 5.0 |
|---|---|---|---|---|---|---|---|---|
| DISCHARGE START VOLTAGE(V) | 1600 | 1461 | 1433 | 1412 | 1381 | 1368 | 1328 | 1217 |

| t2(μs) | 1.5 | 2.0 | 2.5 | 3.0 | 3.5 | 4.0 | 5.0 | 6.0 |
|---|---|---|---|---|---|---|---|---|
| SUSTAIN START VOLTAGE(V) | 412 | 448 | 476 | 505 | 520 | 539 | 566 | 649 |

FIG. 13C

| t(μs) | | 2.0 | 3.0 | 4.0 | 5.0 | 6.0 |
|---|---|---|---|---|---|---|
| TYPE13A | SUSTAIN START VOLTAGE(V) | 448 | 505 | 539 | 566 | 649 |
| TYPE13B | SUSTAIN START VOLTAGE(V) | NO DIS-CHARGING | INSTA-BILITY | INSTA-BILITY | INSTA-BILITY | 873 |

FIG. 14C

| t(μs) | | 2.0 | 3.0 | 4.0 | 5.0 | 6.0 |
|---|---|---|---|---|---|---|
| TYPE14A | SUSTAIN START VOLTAGE(V) | 448 | 505 | 539 | 566 | 649 |
| TYPE14B | SUSTAIN START VOLTAGE(V) | INSTA-BILITY | INSTA-BILITY | INSTA-BILITY | INSTA-BILITY | INSTA-BILITY |

GAS DISCHARGE IMAGE DISPLAY

BACKGROUND OF THE INVENTION

1. Field of the Invention

The present invention relates to improvement in drive control of a gas discharge image display including a plurality of gas discharge lamps as light sources for use in an image display unit, an electric bulletin board or the like.

2. Description of Related Art

FIG. 1 is a perspective view of a fluorescent lamp included in a conventional gas discharge image display disclosed in, for example, U.S. Pat. No. 5,444,335. In FIG. 1, a reference numeral 1 denotes a fluorescent lamp, a reference numeral 2 denotes a cylindrical glass bulb included in the fluorescent lamp 1, a reference numeral 3 denotes a fluorescent layer formed on substantially a half of the inner wall of the glass bulb 2, and a reference numeral 4 denotes a light output section on which the fluorescent layer 3 is not formed. Within the glass bulb 2, a rare gas such as xenon is sealed at a predetermined pressure. On the outer wall of the glass bulb 2 where the fluorescent layer 3 is formed, external electrodes 5*a* and 5*b* are provided so as to together form a picture element 6.

One florescent lamp 1 includes a plurality of, for example, sixteen picture elements 6. In FIG. 1, merely three picture elements are shown.

FIG. 2 shows a gas discharge image display 7 formed by aligning a plurality of (for example, 3×n) fluorescent lamps 1 of FIG. 1. FIG. 3 shows drive circuits for these fluorescent lamps 1, adjacent three of which are respectively used as red, green and blue (hereinafter referred to as R, G and B) light sources.

FIG. 3 is a block diagram of a drive unit of the conventional gas discharge image display described in the aforementioned U. S. P., wherein a reference numeral 7 denotes a gas discharge image display, and a reference numeral 6 denotes one picture element including the external electrodes 5*a* and 5*b*.

In FIG. 3, a reference numeral 8 denotes an X drive circuit (data drive circuit) connected with each column line (X line) formed by mutually connecting one of the electrodes on one side (for example, the electrode 5*a*) of each longitudinally aligned picture element 6, and a reference numeral 9 denotes a Y drive circuit (scanning drive circuit) connected with each row line (Y line) formed by mutually connecting the other electrode on the other side (for example, the electrode 5*b*) of each laterally aligned picture element 6.

In FIG. 3, the line numbers of the X lines are indicated as XR1, XG1, XB1, . . . and XBn, and the line numbers of the Y lines are indicates as Y1, Y2, . . . and Yn.

As is shown in FIG. 3, the X line is a line formed by mutually connecting one electrode of each of the picture elements 6 included in one fluorescent lamp, and the Y line is a line formed by connecting the other electrode of each of the picture elements 6 positioned at the same row of the plural laterally aligned fluorescent lamps.

The operation of this drive unit will now be described. Each fluorescent lamp 1 has a characteristic that it emits light as a result of the discharge when a predetermined or larger voltage (hereinafter referred to as the discharge start voltage) is applied between the external electrodes 5*a* and 5*b* and it never emits light under application of a voltage smaller than the predetermined voltage.

Common lines of the X drive circuit 8 and the Y drive circuit 9 are connected with each other. Therefore, when a difference in voltages respectively applied to the X line and the Y line by the X drive circuit 8 and the Y drive circuit 9 exceeds the discharge start voltage, the picture element 6 positioned at the intersection of the X and Y lines emits light because a discharge occurs. Since the Y line is a scanning line, the picture elements are successively or arbitrarily scanned in the Y direction by the Y drive circuit 9 for the voltage application. Since the X line is a data line, in accordance with the timing of scanning the Y line of a given picture element 6 where discharge light emission is desired to be caused, the X line connected to this picture element is supplied with a voltage. Ill this manner, the picture element at the intersection emits light as a result of the discharge.

Thus, it is possible to cause the discharge light emission in an arbitrary picture element so as to display an image. Such a fluorescent lamp 1 has a function to easily retain two states, that is, a discharge light emitting state and an off state (which function is hereinafter referred to as the memory function). As a drive system utilizing this memory function, memory drive system is adopted. In the memory drive system, the operation period is divided into a write period, a sustain period and an erase period. A picture element which has been discharged in the write period retains its discharge light emission during the sustain period by applying a voltage lower than the discharge start voltage at appropriate intervals (which voltage is designated as the sustain pulse). When the application of the sustain pulse is stopped or the applied voltage is lowered ill the erase period, the discharge light emission of the picture element stops. Accordingly, this drive system call attain a displayed image with high luminance as compared with the other known drive systems such as refresh drive system in which a picture element emits light only in a scanning period.

When the memory drive system is adopted, all the picture elements are substantially always supplied with the sustain pulse. The discharge light emission of an arbitrary picture element can be controlled by conducting write scanning (at a high voltage) and erase scanning (at a low voltage).

FIG. 4 shows the waveforms of drive voltages in the memory drive system disclosed in the above described patent, wherein the waveforms of voltages applied to an X line (data line), a Yi line (scanning line) and a Yj line (scanning line), and voltages applied between the X and Yi lines and between the X and Yj lines are shown in this order from the top of the drawing.

In FIG. 4, XSP and YSP are sustain pulses supplied to the X and Y lines, respectively, and XWP and YWP are write pulses supplied to the X and Y lines, respectively. In this figure, the Yj line merely means a line adjacent to the Yi line.

The X line serving as a data line is supplied with the write pulse XWP in accordance with the content of an image to be displayed, and is fixed at the GND potential (shown as 0 in FIG. 4) when the write pulse is not applied. At this point, the peak value of the pulse XWP) is sufficiently higher than the peak value of the pulse XSP for attaining a stable display. The Y line serving as a scanning line is supplied with a positive or negative pulse in accordance with the operation periods.

As a result, the waveforms of the voltage applied between the X and Y lines are obtained as those shown in the fourth (waveform X Yi) and the fifth (waveform X-Yj). The peak value obtained by overlapping the pulses XWP and YWP (shown as 60 in FIG. 4) is sufficiently higher than the discharge start voltage. Furthermore, a voltage applied when the pulse YSP is not supplied is lower than a voltage sufficiently high for retaining the discharge. Therefore, a picture element at the intersection of the X and Yi lines starts its discharge light emission in the write period, retains the discharge light emission in the sustain period, and stops the discharge light emission in the erase period.

Another type of fluorescent lamps like one disclosed in U.S. application Ser. No. 08/545,274 now U.S. Pat. No. 5,668,443 (filed by the Applicant) can be used in such an image display, apart from that shown in FIG. 1. The fluorescent lamp disclosed in this application is shown in FIGS. 5A and 5B.

FIG. 5A is a partially exploded perspective view of the fluorescent lamp, and FIG. 5B is a vertically sectional view thereof. In these figures, a reference numeral 11 denotes the fluorescent lamp including an external electrode and an internal electrode, and a reference numeral 12 denotes a glass bulb included in the fluorescent lamp 11.

A reference numeral 13 denotes the internal electrode inserted from one end portion of the glass bulb 12 into the glass bulb 12, a reference numeral 14 denotes the external electrode disposed on the outer wall of the glass bulb 12, and a reference numeral 15 denotes a fluorescent layer formed on the inner wall of the glass bulb 12.

A reference numeral 16 denotes a transparent light output section disposed at the upper end of the glass bulb 12. A rare gas such as xenon is sealed within the glass bulb 12 at a predetermined pressure. A reference numeral 49 denotes an AC power supply for allowing the fluorescent lamp 11 to emit light.

A plurality of such fluorescent lamps 11 are connected with one another as is shown in FIG. 3, so as to form a gas discharge image display 7. Differently from the fluorescent lamp 1, the two electrodes of the fluorescent lamp 11 are not symmetrically disposed. Therefore, apart from the case where the image display is driven by using an AC waveform in which symmetrical positive and negative waves are repeated, in driving the image display by using a pulse signal including asymmetrical positive and negative waves such as the waveform X-Yi shown in FIG. 4, the characteristics of the fluorescent lamp 11 (Such as a voltage value of a pulse required for attaining stable emission) are varied depending upon which electrode is supplied with a positively (or negatively) biased potential.

In such a case, when the image display is used without consideration of the polarities of the pulse signal, a high supply voltage is uneconomically required, or a stable operation cannot be disadvantageously attained.

Since the conventional gas discharge image display has the aforementioned configuration, the peak value of the sustain pulse in the sustain period varies depending upon whether another pulse XWP for starting discharge light emission of another picture element at a different intersection from that of the X and Yi lines (hereinafter referred to as other line write operation) is applied (as is shown as a period [3] in FIG. 4) or is not applied (as is shown as a period [2] in FIG. 4). As a result, the intensity of the discharge occurring at the rise of the sustain pulse is varied, resulting in disadvantageously fluctuating the emission intensity.

As another problem, the required voltage value of a pulse can be unnecessarily increased depending upon combination of supply of the two types of the pulse signals to the two electrodes.

SUMMARY OF THE INVENTION

The present invention was devised to overcome the aforementioned problems, and one object of the invention is providing a gas discharge image display in which emission intensity is scarcely fluctuated by the other-line write operation.

The gas discharge image display of this invention comprises a plurality of discharge lamps, disposed in a matrix form, each having a characteristic of a predetermined discharge start voltage and including a dielectric cylindrical container in which a rare gas is sealed and first and second electrodes disposed oil the cylindrical container, the discharge lamps forming row lines by mutually connecting the first electrodes of the discharge lamps disposed in a lateral direction of the matrix form and forming column lines by mutually connecting the second electrodes of the discharge lamps disposed in a longitudinal direction of the matrix form; and a row line drive circuit and a column line drive circuit connected with the row lines and the column lines, respectively, for applying pulse voltages to the row lines and the column lines, the row line drive circuit and the column line drive circuit simultaneously supplying write pulses having polarities reverse to each other to a row line and a column line to which a discharge lamp to be discharged is connected, so as to apply a voltage exceeding the discharge start voltage to the discharge lamp to be discharged, and the row line drive circuit and the column line drive circuit supplying sustain pulses to the row line and the column line at timing different from timing of supplying the write pulses, so as to apply a voltage lower than the discharge start voltage to the discharge lamp to be discharged. In this gas discharge image display, a peak value of the write pulse supplied to one of the first and second electrodes is substantially equal to a peak value of the sustain pulse supplied to the electrode.

Accordingly, even when a write pulse for the other-line write operation is supplied in the sustain period of the discharge lamp to be discharged, the peak value of the write pulse can be retained as in the case where the write pulse for the other-line write operation is not supplied. Therefore, emission luminance is not varied in the sustain period.

Another object of the invention is providing a gas discharge image display which can decrease the sustain start voltage for a discharge when a first electrode which is a internal electrode disposed into the cylindrical container and a second electrode which is a external electrode disposed on outer wall of the cylindrical container are used.

In the present gas discharge image display, the write pulses and the sustain pulses have such polarities that the internal electrode first works as a negative electrode and the external electrode subsequently works as the negative electrode in each discharge lamp after a period when no voltage is applied by the row line drive circuit and the column line drive circuit.

In the present gas discharge image display, the write pulses are supplied ill a period when the internal electrode of the discharge lamp works as the negative electrode.

Therefore, the discharge can be stably sustained at a low voltage, resulting in decreasing the sustain voltage.

Still another object of the invention is providing a gas discharge image display in which the discharge between the internal electrode and the external electrode call be easily caused.

Alternatively, the gas discharge image display of this invention comprises a plurality of discharge lamps, disposed in a matrix form, each having a characteristic of a predetermined discharge start voltage and including a dielectric cylindrical container which has different diameters in an axial direction and in which a rare gas is sealed, a first electrode disposed into the cylindrical container, and second and third electrodes disposed on outer walls of portions having the different diameters of the cylindrical container, the discharge lamps forming row lines by mutually connecting the first electrodes of the discharge lamps disposed in a lateral direction of the matrix form and forming column lines by mutually connecting the second electrodes of the discharge lamps disposed in a longitudinal direction of the matrix form, and the third electrode being connected with the second electrode in each discharge lamp; and a row line drive circuit and a column line drive circuit connected with the row lines, and the column lines, respectively, for applying pulse voltages to the row lines and the column lines, the row line drive circuit and the column line drive circuit simultaneously supplying write pulses having polarities reverse to each other to a row line and a column line to which a discharge lamp to be discharged is connected, so as to apply a voltage exceeding the discharge start voltage to the discharge lamp to be discharged, and the row line drive circuit and the column line drive circuit supplying sustain pulses to the row line and the column line at timing different from timing of supplying the write pulses, so as to apply a voltage lower than the discharge start voltage to the discharge lamp to be discharged.

Accordingly, the discharge between the external electrode serving as the third electrode and the internal electrode can be caused without using additional driving circuits.

The above and further objects and features of the invention will more fully be apparent from the following detailed description with accompanying drawings.

BRIEF DESCRIPTION OF THE DRAWINGS

FIG. 13C is a table showing measured values of a sustain start voltage;

FIG. 14C is a table showing measured values of a sustain start voltage;

DESCRIPTION OF THE PREFERRED EMBODIMENTS

The present invention will now be described referring to the accompanying drawings showing the embodiments thereof.

Embodiment 1

Figure 6:
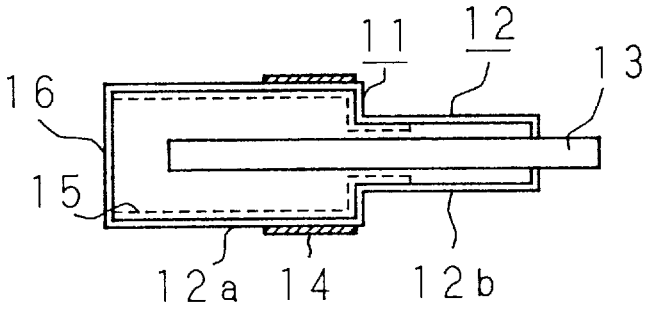
FIG. 6 is a vertically sectional view of a fluorescent lamp according to Embodiment 1 of the invention.

In FIG. 6, a reference numeral 11 denotes a fluorescent lamp included in a gas discharge image display of this invention, a reference numeral 12 denotes a glass bulb (container) included in the fluorescent lamp 11 and having two portions with different diameters in the axial direction, a reference numeral 12*a* denotes the large-diameter portion of the glass bulb 12, and a reference numeral 12*b* denotes the small-diameter portion of the glass bulb 12.

A reference numeral 13 denotes an internal electrode, that is, a first electrode, inserted from one end of the small-diameter portion 12*b* of the glass bulb 12 into the glass bulb 12. A reference numeral 14 denotes an external electrode, that is, a second electrode, disposed on the outer wall of the large-diameter portion 12*a* of the glass bulb 12. A reference numeral 15 denotes a fluorescent layer formed on the inner wall and the inner bottom of the large-diameter portion 12*a* of the glass bulb 12.

A reference numeral 16 denotes a transparent light output section disposed at the upper end (at the left end in FIG. 6) of the large-diameter portion 12*a* of the glass bulb 12. A rare gas such as xenon is sealed within the glass bulb 12 at a predetermined pressure.

Figure 7:
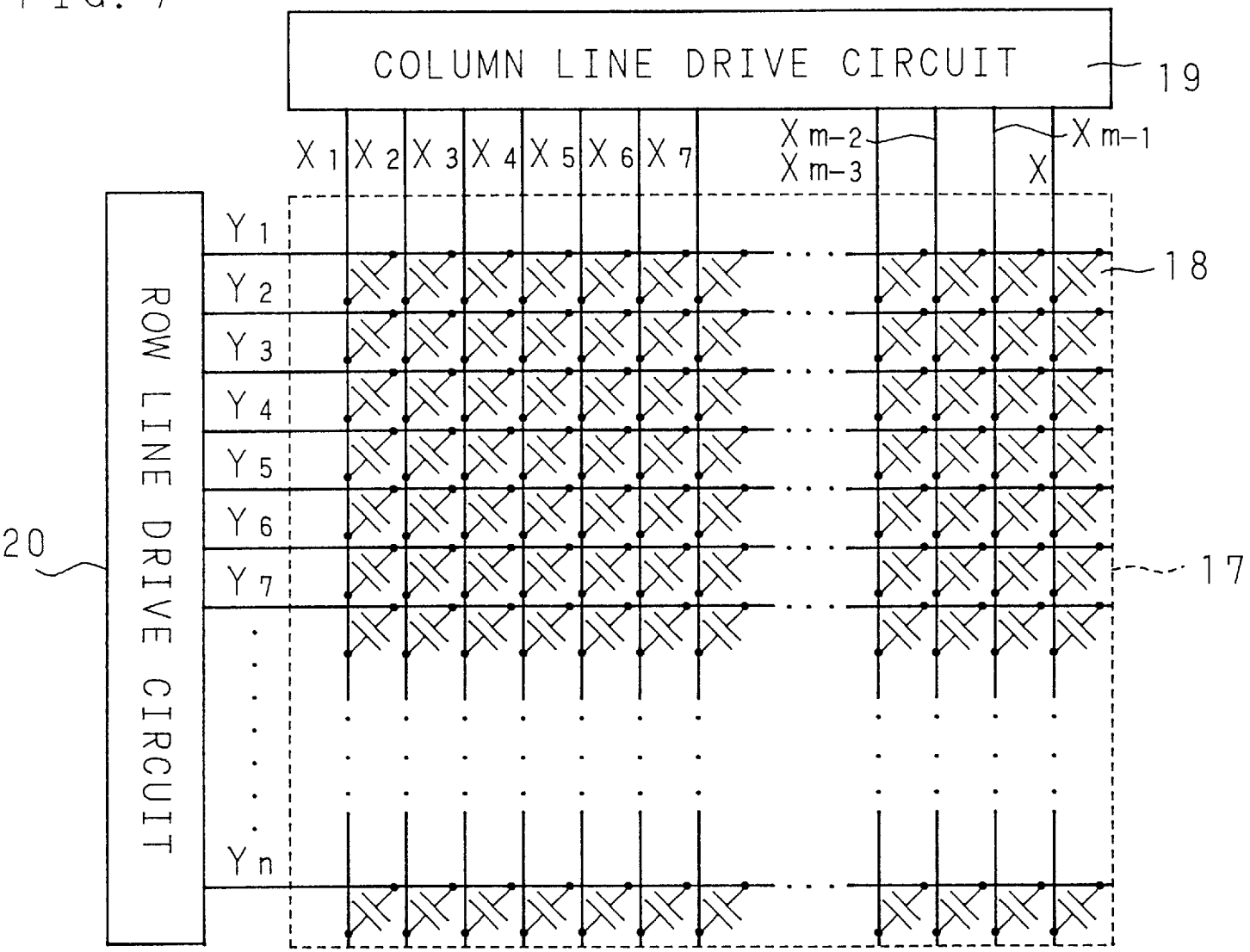
FIG. 7 is a block diagram showing a drive unit of a gas discharge image discharge image display of Embodiment 1.

FIG. 7 is a block diagram showing a drive unit of a gas discharge image display of this invention. A reference numeral 17 denotes the gas discharge image display, and a reference numeral 18 denotes a picture element including the fluorescent lamp 11. A reference numeral 19 denotes a column line drive circuit (data drive circuit) connected to each column line formed by mutually connecting the same one of the electrodes (for example, the external electrode 14) of each luminescent lamp 11 aligned in the longitudinal direction. A reference numeral 20 denotes a row line drive circuit (scanning drive circuit) connected to each row line formed by mutually connecting the other electrode (for example, the internal electrode 13) of each fluorescent lamp 11 aligned in the lateral direction.

Now, the operation of the gas discharge image display will be described. When a voltage exceeding a discharge start voltage is applied to a column line and a row line by the column line drive circuit 19 and the row line drive circuit 20, respectively, the picture element 18 (i.e., the fluorescent lamp 11) at the intersection of the lines discharges and emits light. Since the row line is a scanning line, the picture elements are successively or arbitrarily scanned in the longitudinal direction for the voltage application. Since the column line is a data line, when the row line connected to a picture element which is desired to be discharged for light emission is scanned, a voltage is applied to the column line connected to that picture element, so as to cause the discharge light emission of that picture element at the intersection.

Figure 8:
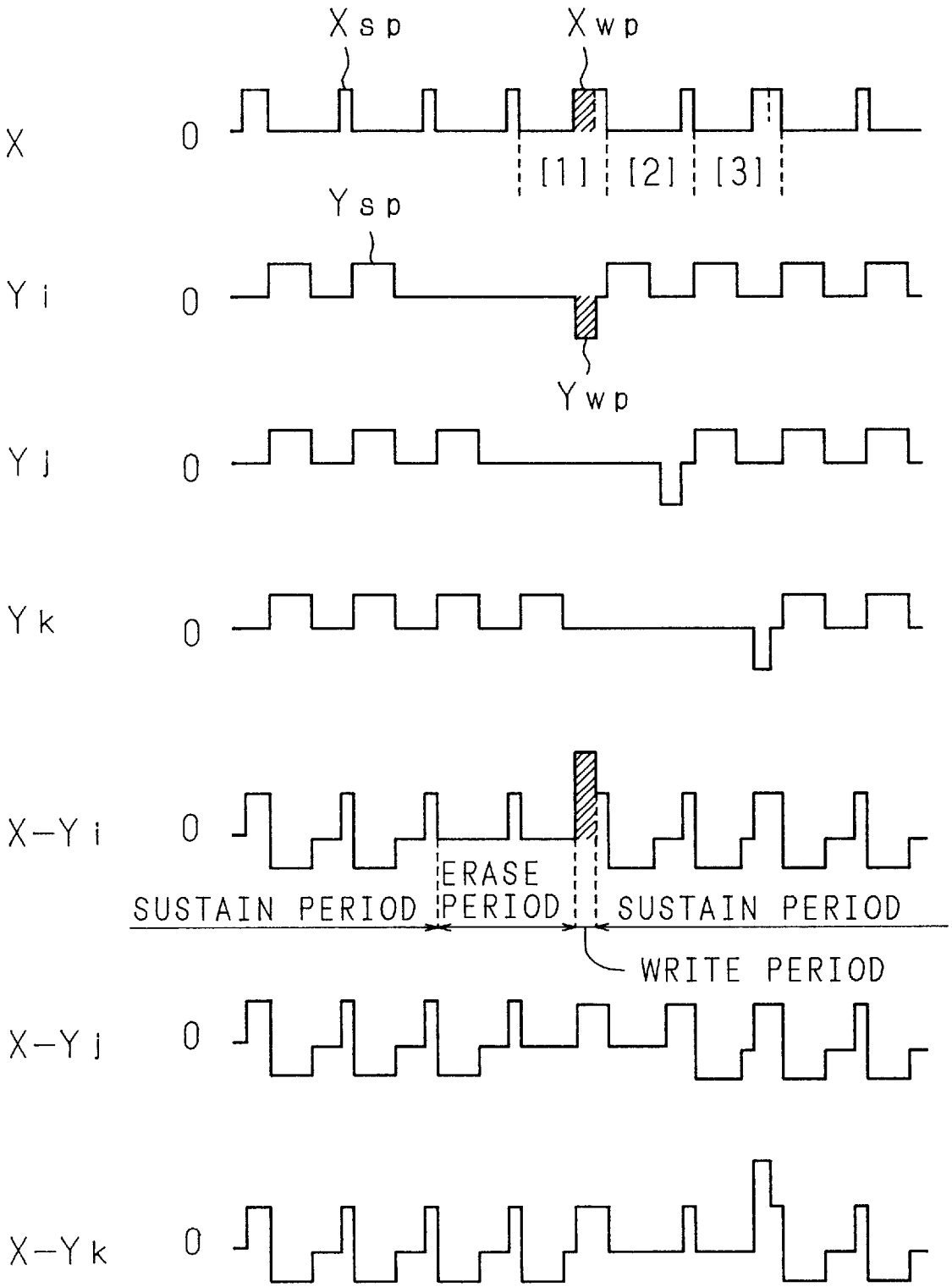
FIG. 8 is a chart for showing the waveforms of drive voltages in the gas discharge image display of Embodiment 1.

FIG. 8 shows the waveforms of drive voltages in the present gas discharge image display, wherein the waveforms of voltages applied to a column line (data line) X, row lines (scanning lines) Yi, Yj and Yk, and voltages applied between the X and Yi lines, the X and Yj lines, and the X and Yk lines resulting from the voltage application to these lines are shown in this order from the top. In FIG. 8, XSP and YSP are sustain pulses supplied to the data and scanning lines, respectively, and XWP and YWP) are write pulses supplied to the data and scanning lines, respectively. At this point, the peak value of the pulse XWP is set at a value substantially equal to or slightly lower than the peak value of the pulse XSP.

The row line is a scanning line, and is supplied with a voltage pulse in accordance with the operation period, which is divided into a write period, a sustain period and an erase period. In contrast, the column line is a data line, and is arbitrarily supplied with the write pulse XWP in accordance with the content of an image to be displayed. The sustain pulse XSP is always regularly applied. In FIG. 8, the widths of the pulses XWP and YWP are substantially the same.

Figure 9:
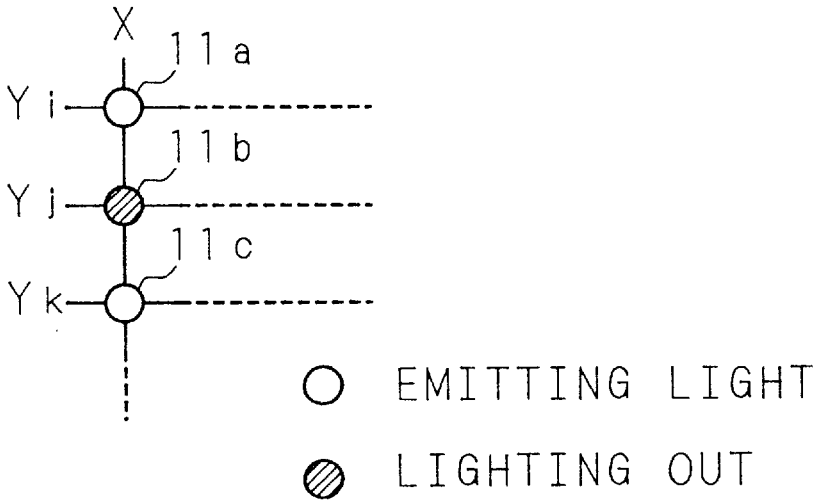
FIG. 9 is a diagram for showing a display obtained by using the waveforms of FIG. 8.

Now, a voltage pulse applied to the column line X (hereinafter referred to as the X line) for attaining a display as shown in FIG. 9 (wherein fluorescent lamps 11*a* and 11*c* emit light and a fluorescent lamp 11*b* is off) will be exemplified. In successively scanning the row lines, the write pulse XWP is applied to the X line when the write pulse YWP is applied to the row line Yi (hereinafter referred to as the Yi line) (as in a period [1] shown in FIG. 8). When the write pulse YWP is applied to the row line Yj (hereinafter referred to as the Yj line) (as in a period [2] shown in FIG. 8), the write pulse XWP is not applied to the X line. When the write pulse YWP is applied to the row line Yj (hereinafter referred to as the Yj line) (as in a period [3] shown in FIG. 8), the write pulse XWP is applied to the X line. As a result, the waveform of the drive voltage applied to the X line is obtained as that shown in the first of FIG. 8.

At this point, with regard to the fluorescent lamp 11*a* at the intersection of the X line and the Yi line, the fluorescent lamp 11*a* starts discharging in the write period of the Yi line (i.e., the period [1]), retains the discharge in the sustain period (i.e., the periods [2] and [3]). However, the waveforms of the voltages applied to the fluorescent lamp 11*a* in the periods [2] and [3] are different from each other depending upon whether or not the pulse XWP is applied.

As described above, the peak value of the write pulse XWP is larger than that of the sustain pulse XSP in the conventional gas discharge image display. Therefore, the voltage applied between the X and Yi lines in the period [3] is higher than in the period [2]. In the present gas discharge image display, however, since the peak values of the write pulse XWP and the sustain pulse XSP are substantially the same, there is no difference in the voltage applied between the X and a Yi lines in the periods [2] and [3]. As a result, a difference in the intensity between the discharge occurring in the period [2] and that occurring in the period [3] is decreased, and hence, the variation of the emission luminance caused by the other-line write operation can be decreased.

Figure 10:
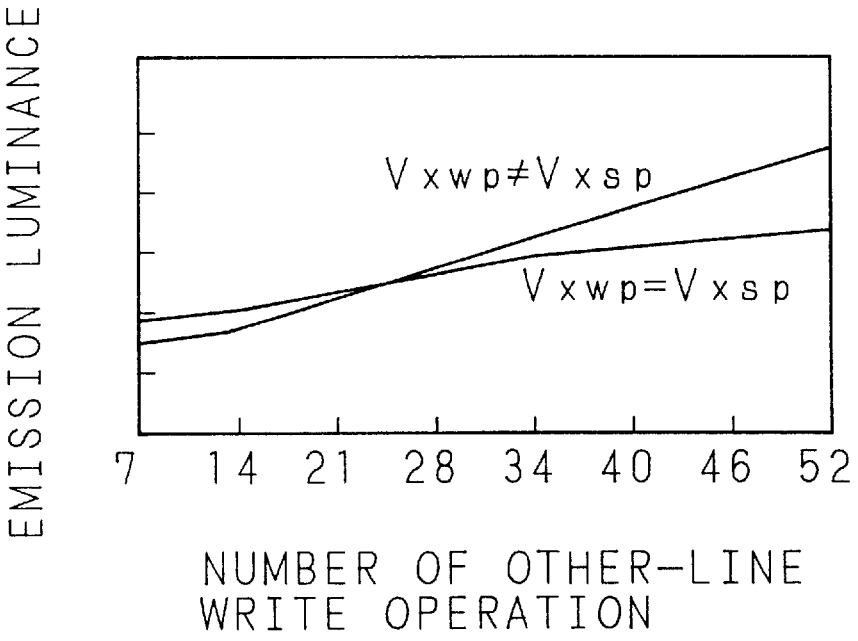
FIG. 10 is a graph for showing the relationship between the number of other-line write operation and emission luminance.

In the present gas discharge image display, the emission luminance of the luminescent lamp (picture element) at the intersection of the X and Yi lines is measured with varying the number of the other-line write operation, the results of which are shown in FIG. 10. In FIG. 10, the ordinate indicates the emission luminance, and the abscissa indicates the number of the other-line write operation. This graph reveals that the increase of the emission luminance be suppressed to be very small when the peak value (VxWP) of the write pulse XWP is the same as the peak value (VxSP) of the sustain pulse XSP as compared with the case where they are different.

Each of the row lines Yi through Yk is supplied with the write pulse YWP with a different polarity from that of the sustain pulse YSP when each line is scanned (selected). As a result, the waveform of the voltage applied between the X and Yi lines is obtained as that shown in the fifth (waveform X-Yi) of FIG. 8. In the write period of the Yi line (i.e., the period [1] FIG. 8), a voltage obtained as the sum of the peak values of the pulses XWP and YWP is applied to the luminescent lamp 11*a* at the intersection of the X and Yi lines.

Since the voltage obtained as the sum of the peak values of the pulses XWP and YWP is set to be higher than the discharge start voltage, the luminescent lamp 11*a* discharges. Furthermore, the waveform of the voltage applied between the X and Yj lines is obtained as that shown in the sixth of FIG. 8. A voltage applied to the luminescent lamp 11*b* at the intersection of the X and Yj lines in the write period of the Yj line (i.e., the period [2]) has the peak value of the pulse YWP because the write pulse XWP is not applied. Since the peak value of the pulse YWP is set to be lower than the discharge start voltage, the luminescent lamp 11*b* does not discharge.

Moreover, a voltage applied to the luminescent lamp 11*a* at the intersection of the X and Yi lines in the period [3] has the peak value of the pulse XWP because the write pulse XWP is applied but the write pulse YWP is not applied. Since the peak value of the pulse XWP is set to be lower than the discharge start voltage, the luminescent lamp 11*a* does not discharge also in this case. In this manner, the discharge occurs only in the luminescent lamp positioned at the intersection of the column line supplied with the pulse XWP and the row line supplied with the pulse YWP, and thus, a matrix drive system of the gas discharge image display can be realized.

Embodiment 2

Figures 11A, 11B:
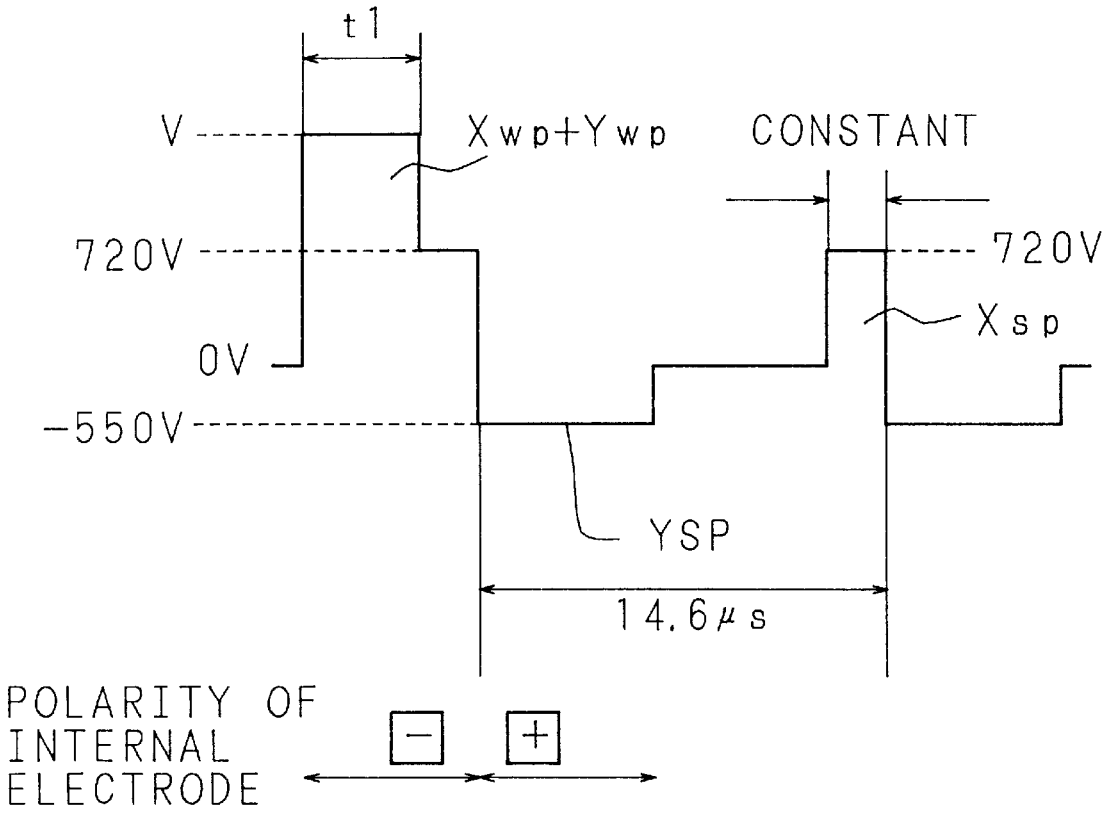
FIG. 11A shows a waveform a drive voltage used in Embodiment 2 of the invention.
FIG. 11B is a table showing measured values of a discharge start voltage in accordance with a pulse width t1.

The variation in the discharge start voltage is measured in the present gas discharge image display with the width of the sustain pulses XSP and YSP being constant and by using the width (t1) of the write pulses XWP and YWP as a parameter. FIG. 11A shows the waveform of a drive voltage used in the measurement, and a voltage V at which the discharge stably occurs during the pulse width t1 is measured by using the width t1 as the parameter. The results obtained in the measurement are listed in FIG. 11B.

Figures 12A, 12B:
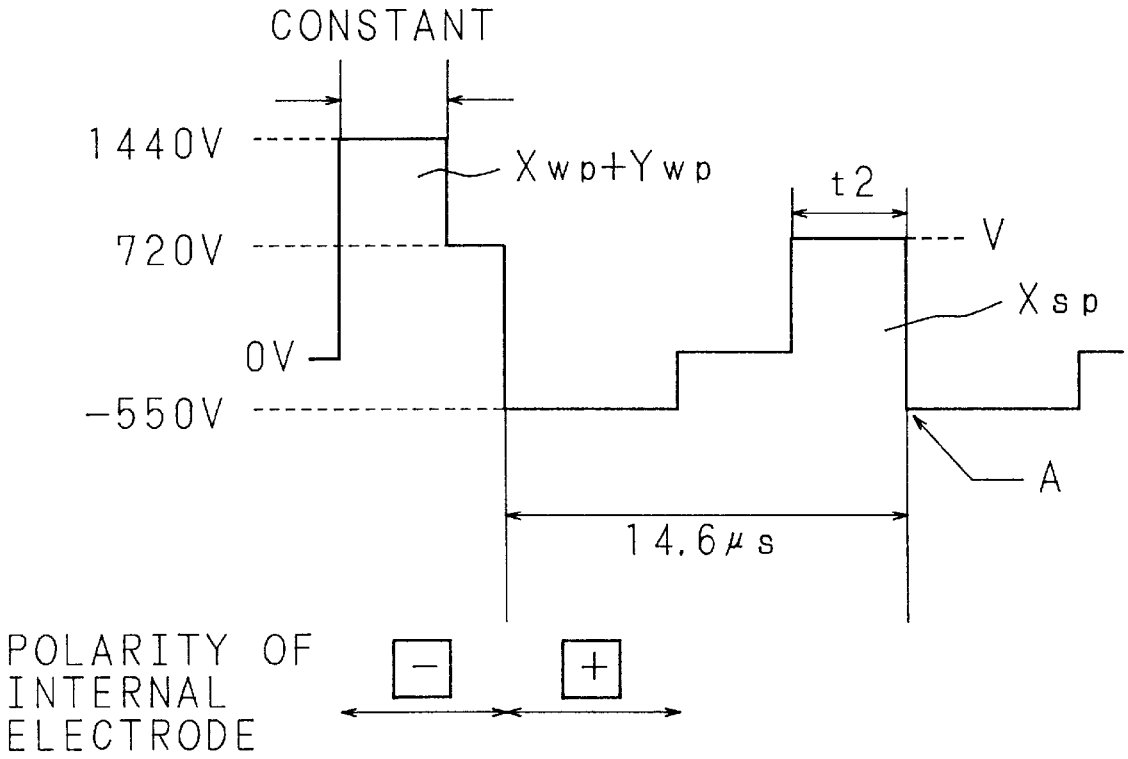
FIG. 12A shows another waveform of the drive voltage used in Embodiment 2.
FIG. 12B is a table showing measured values of a sustain start voltage in accordance with variation of a pulse width t2.

The variation in the sustain start voltage (i.e., the minimum voltage required to sustain a discharge) in a sustain period is measured with the width of the write pulses being constant and by using the width (t2) of a sustain pulse XSP as a parameter. FIG. 12A shows the waveform of a drive voltage used in the measurement, and a voltage V at which the discharge stably occurs at a point A of FIG. 12A is measured by using the pulse width t2 as the parameter. The results obtained in the measurement are listed in FIG. 12B.

FIG. 11B reveals that the discharge start voltage becomes lower as the width t1 of the write pulses is larger, and FIG. 12B reveals that the sustain start voltage becomes lower as the width t2 of the sustain pulse is smaller. Accordingly, a necessary voltage can be decreased by increasing the width of the write pulse and decreasing the width of the sustain pulse, which call be an advantage in the configuration of an image display. In the actual waveform of the drive voltage, it is necessary to consider the sum of the widths of the pulses XWP and XSP as the width of the sustain pulse, as is obvious from the waveform in the period [3] of FIG. 8.

Therefore, when the width of the pulse XWP is increased in order to increase the width of the write pulse and the width of the sustain pulse is made constant, the sum of the widths of the pulses XWP and XSP is also increased. Thus, the above-described conditions are found to conflict each other. Accordingly, in practical use, a point of compromise between these conditions is obtained. Specifically, the sum of the widths of the pulses XWP and XSP is set to be as small as possible, and under this condition, an optimal width of the pulse XSP for attaining the maximum width of the pulse XWP is obtained. At this point, it goes without saying that the width of the write pulses XWP and YWP is advantageously set to be larger than the width of the sustain pulse XSP.

In other words, when the width of the write pulses (XWP and YWP) is larger than that of the sustain pulse (XSP), the drive voltage call be decreased in the resultant image display.

Embodiment 3

Figure 1:
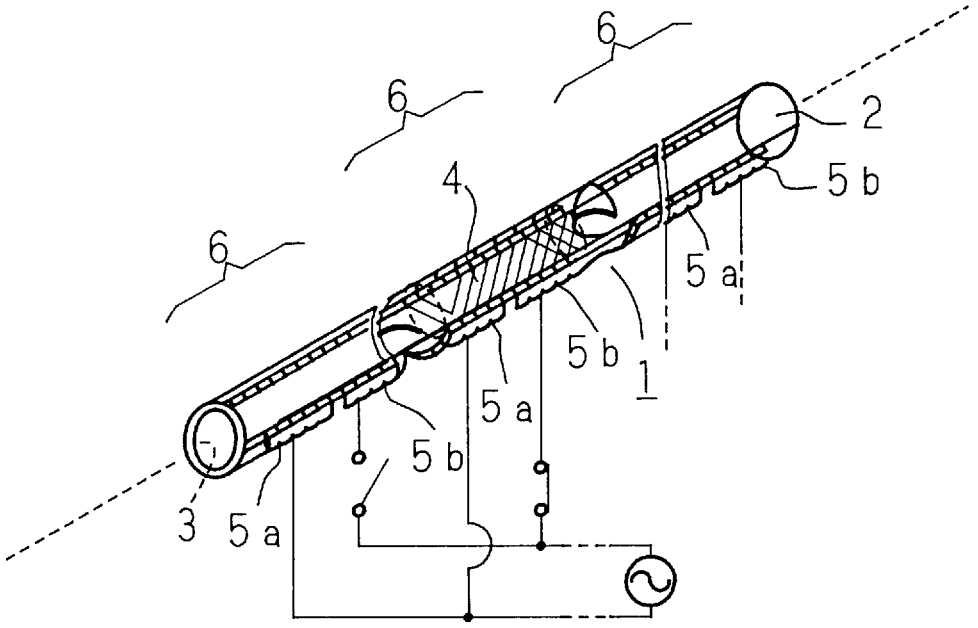
FIG. 1 PRIOR ART
FIG. 1 is a perspective view of a conventional fluorescent lamp.
Figure 2:
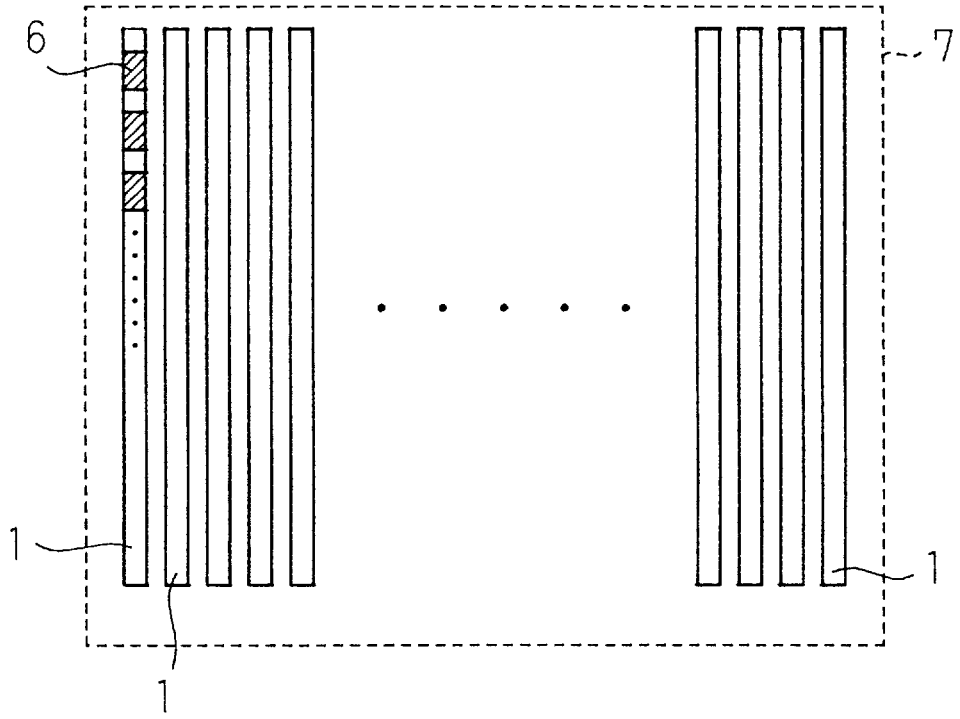
FIG. 2 PRIOR ART
FIG. 2 is a diagram showing an image display including the fluorescent lamp of FIG. 1.
Figure 3:
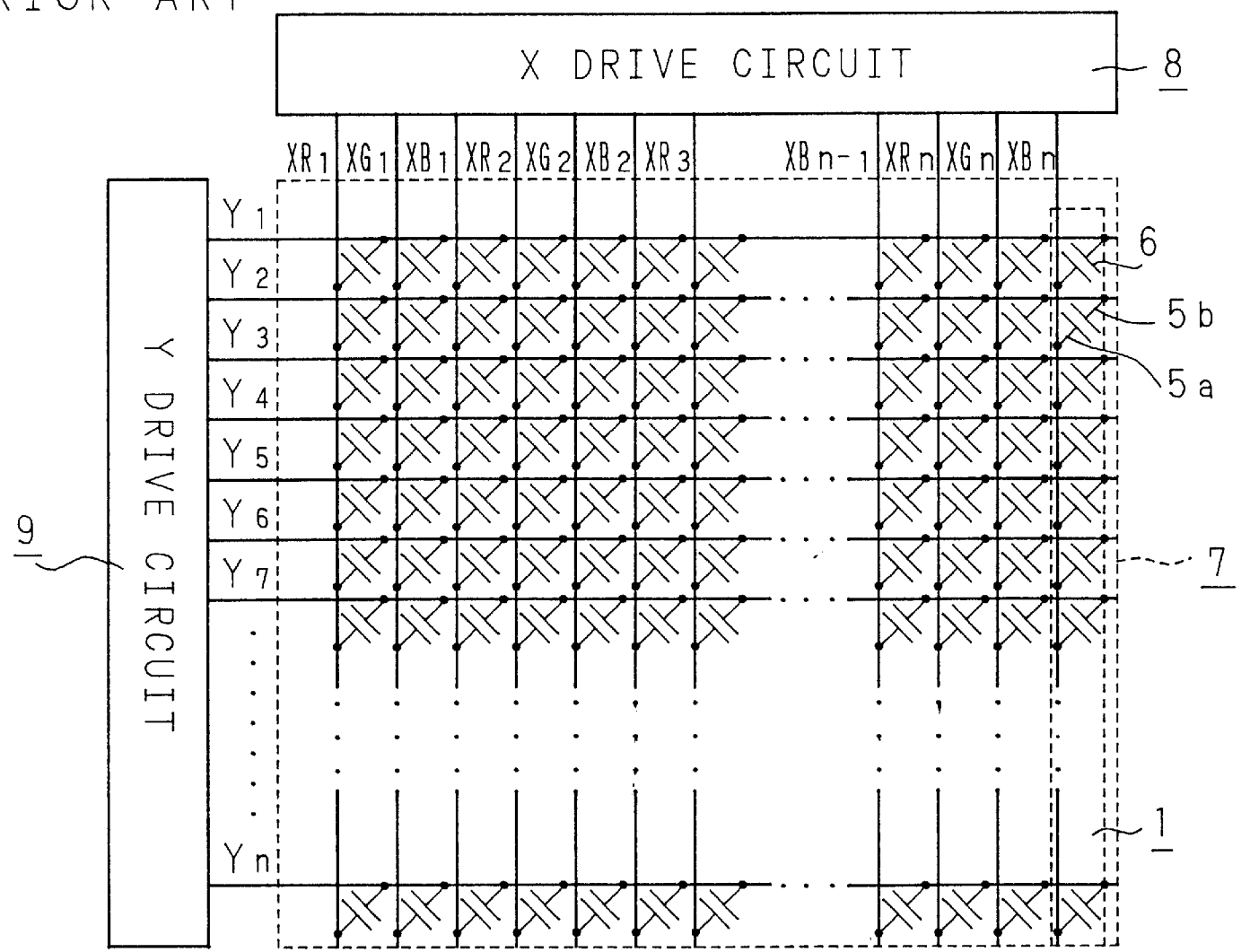
FIG. 3 PRIOR ART
FIG. 3 is a block diagram of a drive unit of a conventional gas discharge image display.
Figure 4:
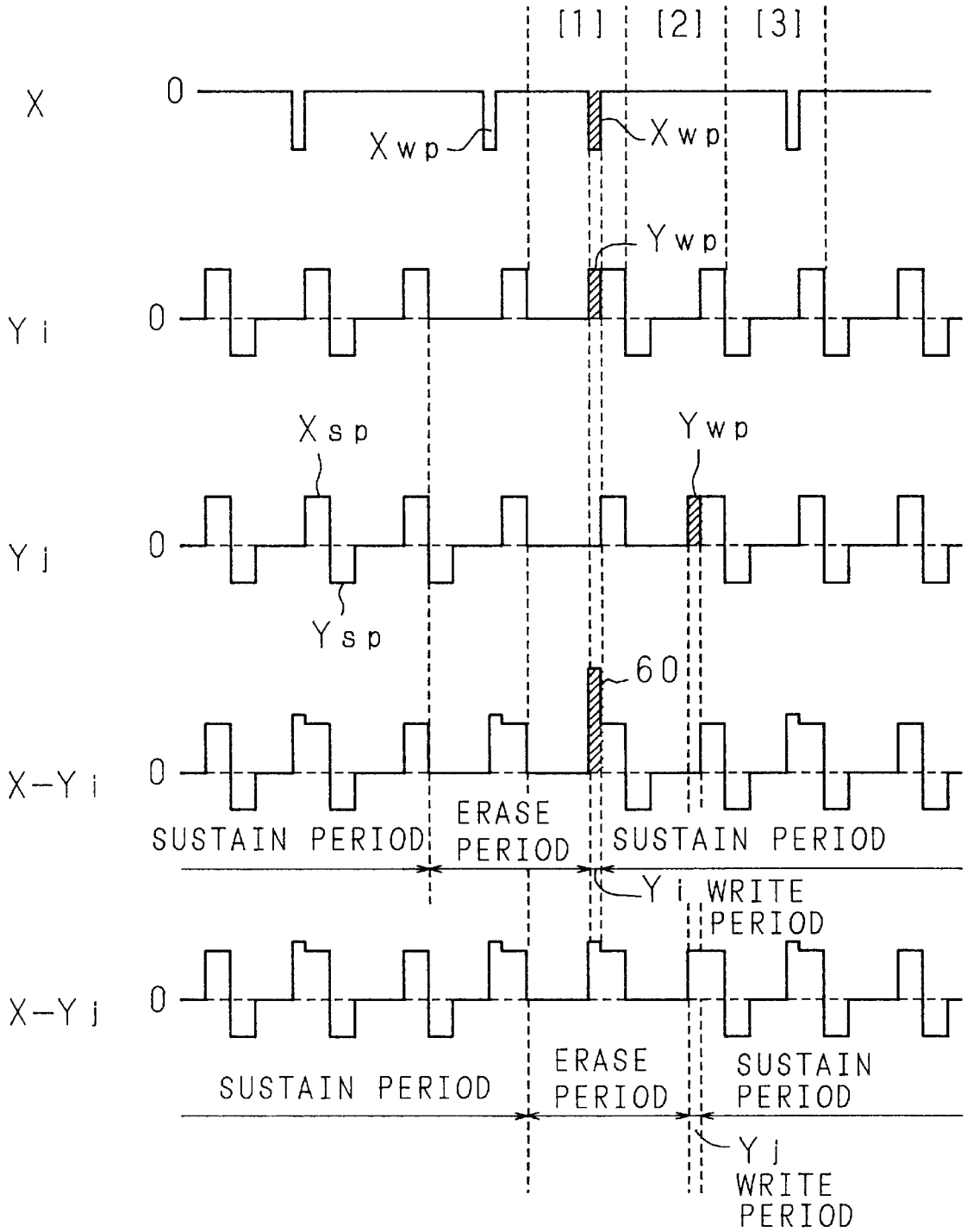
FIG. 4 PRIOR ART
FIG. 4 is a chart for showing the waveforms of drive voltages in the conventional gas discharge image display.
Figure 5A:
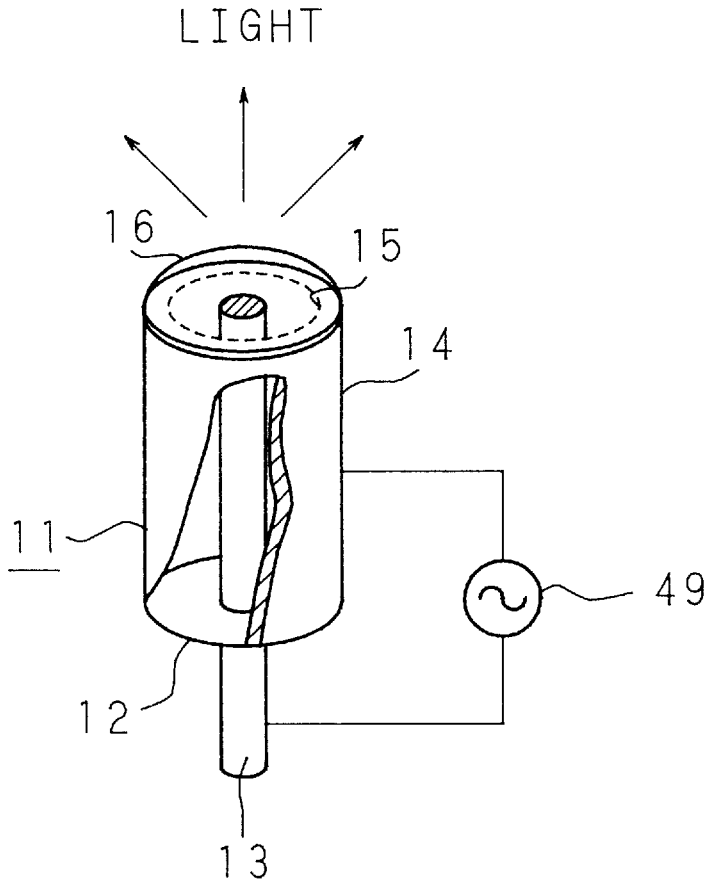
FIG. 5A PRIOR ART
FIG. 5A is a partially exploded perspective view of another conventional fluorescent lamp.
Figure 5B:
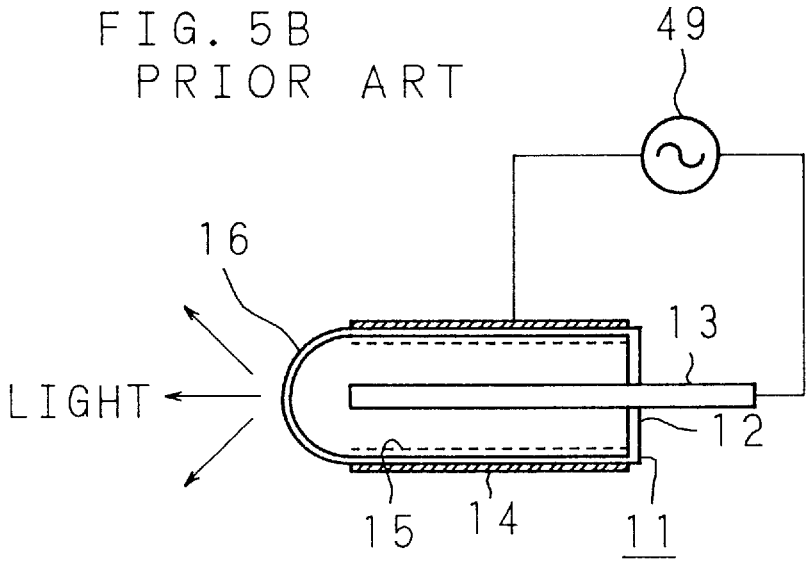
FIG. 5B PRIOR ART
FIG. 5B is a vertically sectional view of the fluorescent lamp of FIG. 5A.

The structure of the fluorescent lamp 11 shown in FIG. 6 is different from that of the fluorescent lamp 1 shown in FIG. 1, and specifically, the two electrodes have different shapes. Also, the waveform of the voltage applied between the X and Yi lines shown in FIG. 8 are not symmetrical with zero as the center of symmetry. Therefore, the characteristics are slightly changed depending upon which electrode is supplied with a positive pulse signal.

The present gas discharge image display is driven, after a rest period in which no pulse voltage is applied, by using a drive voltage with a waveform for first using the internal electrode 13 as a negative electrode and subsequently using the external electrode as the negative electrode. Then, the image display is driven by using a drive voltage with a waveform for first using the external electrode 14 as the negative electrode and subsequently using the internal electrode 13 as the negative electrode. The sustain start voltages are measured in these two cases by using the width of the sustain pulse (XSP) as a parameter.

Figure 13A:
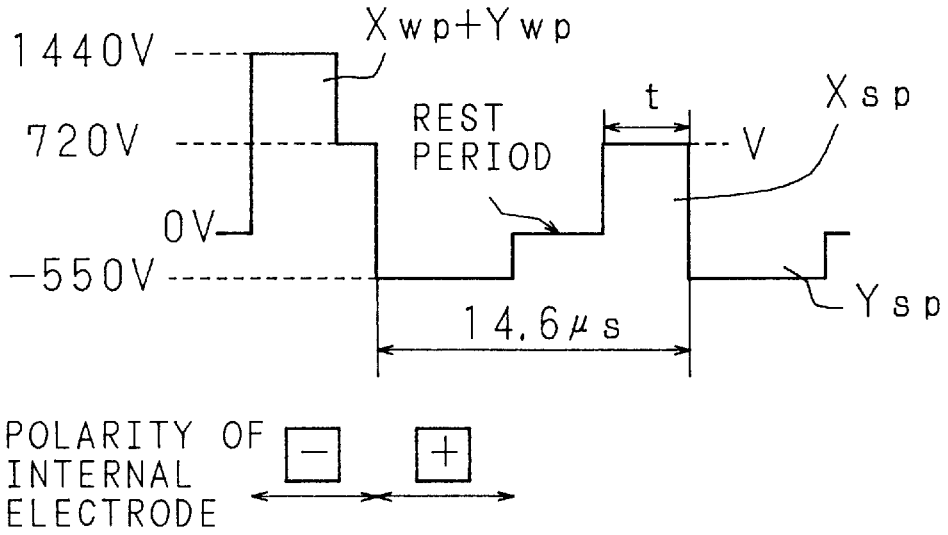
FIG. 13A shows a waveform of a drive voltage used in Embodiment 3 of the invention.
Figure 13B:
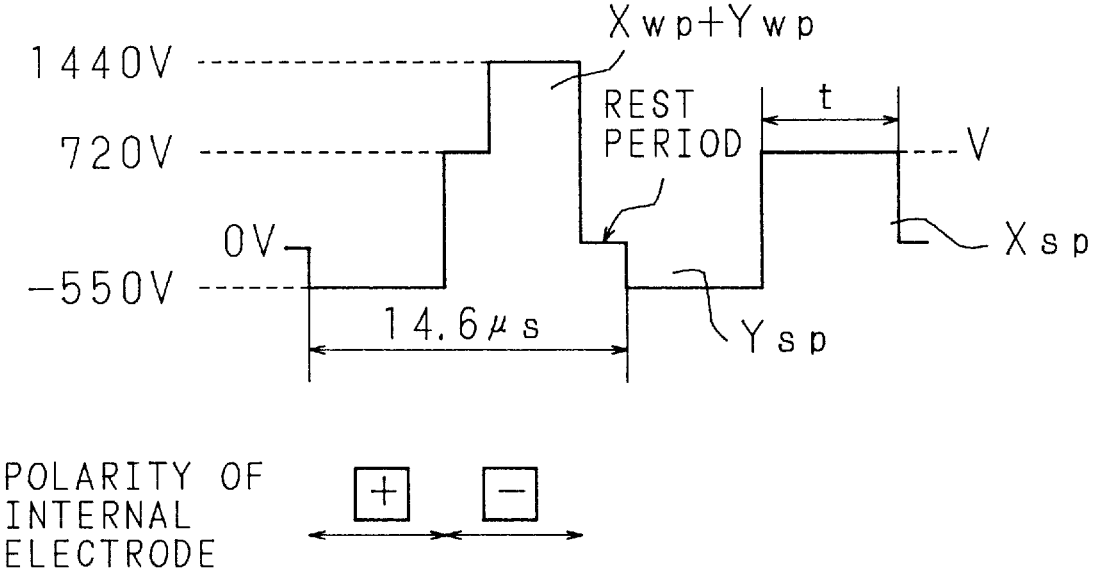
FIG. 13B is a shows another waveform of the drive voltage used in Embodiment 3.

FIG. 13A shows the former waveform, FIG. 13B shows the latter waveform, and FIG. 13C shows the results of the measurement. As is obvious from the results, the sustain start voltage can be decreased by applying the voltage with the waveform for first using the internal electrode 13 as the negative electrode and subsequently using the external electrode 14 as the negative electrode. Thus, this waveform is found to be more advantageous for the configuration of the drive circuit.

Embodiment 4

Figure 14A:
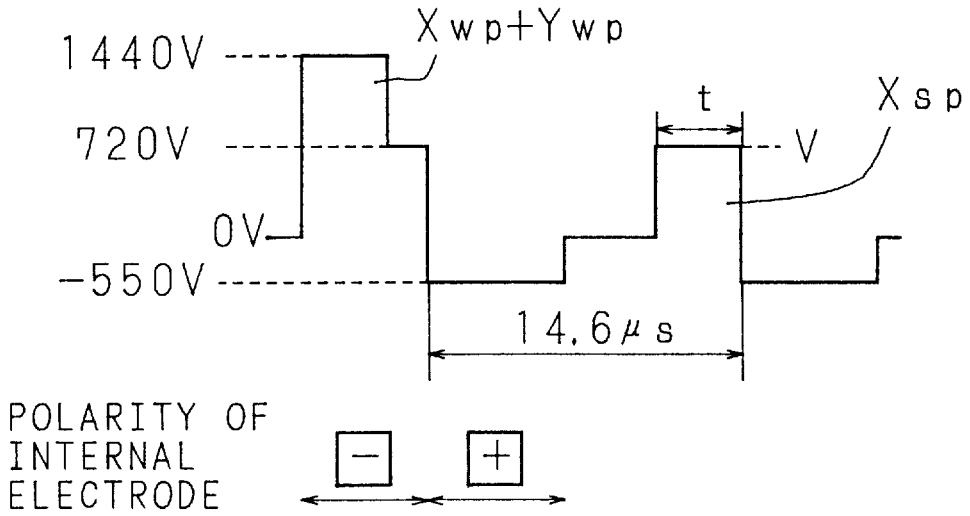
FIG. 14A shows a waveform of a drive voltage used in Embodiment 4.
Figure 14B:
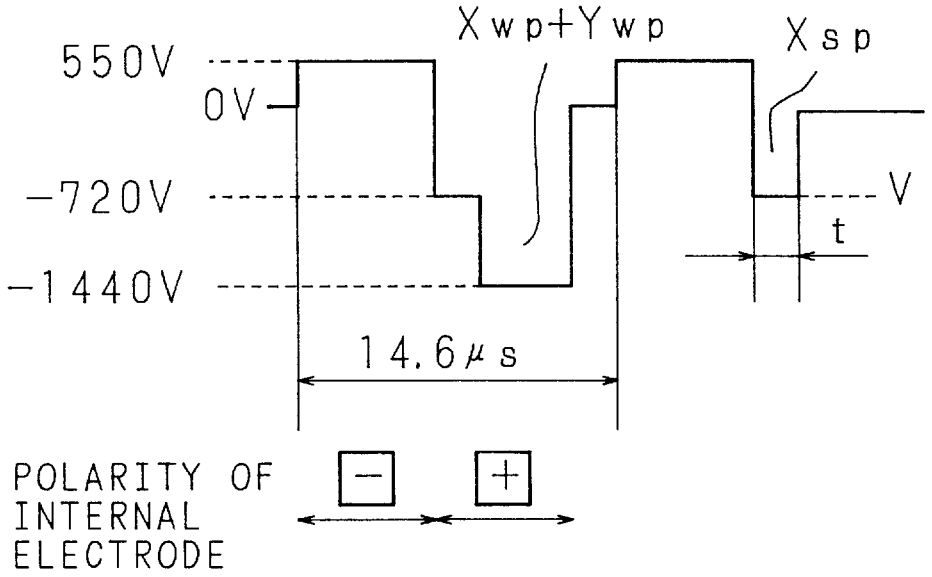
FIG. 14B shows another waveform of the drive voltage used in Embodiment 4.

The present gas discharge image display is driven by using a drive voltage with a waveform for performing a write operation during pulse application using the internal electrode 13 as the negative electrode. Then, the image display is driven by using a drive voltage with a waveform for performing a write operation during pulse application using the internal electrode 13 as the positive electrode. The sustain start voltages are measured in these two cases by using the width of the sustain pulse (XSP) as a parameter. FIG. 14A shows the former waveform, FIG. 14B shows the latter waveform, and FIG. 14C shows the results of the measurement. As is obvious from the results, the sustain start voltage can be decreased by using the voltage with the waveform for performing the write operation during the internal electrode 13 working as the negative electrode. Thus, this waveform is found to be more advantageous in the configuration of the drive circuit.

Embodiment 5

Figure 15:
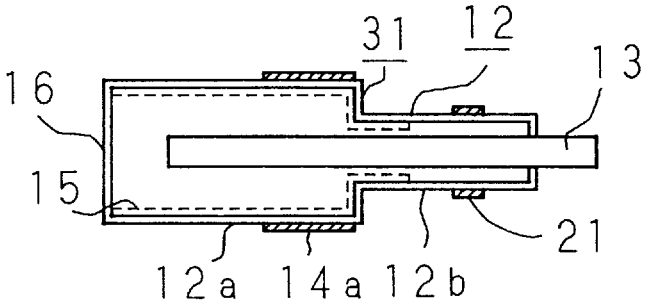
FIG. 15 is a vertically sectional view of a fluorescent lamp of Embodiment 5 of the invention.

FIG. 15 shows another embodiment of this invention, wherein a fluorescent lamp 31 included in the present image display has another external electrode 21, that is, a third electrode, provided on the outer wall of the small-diameter portion 12*b* (similarly to a fluorescent lamp described in U.S. application Ser. No. 08/545,274 now U.S. Pat. No. 5,668,443 filed by the Applicant). An electrode provided on the outer wall of the large-diameter portion 12*a* is an external electrode 14*a*, that is, the second electrode. In this lamp, as disclosed in U.S. application Ser. No. 08/545,274, now U.S. Pat. No. 5,668,443 a discharge is caused by applying a voltage between an internal electrode 13 and the external electrode 21. Owing to the presence of space charges generated by this discharge (hereinafter referred to as the auxiliary discharge), a discharge between the internal electrode 13 and the external electrode 14a (hereinafter referred to as the main discharge) can be easily caused.

Figure 16:
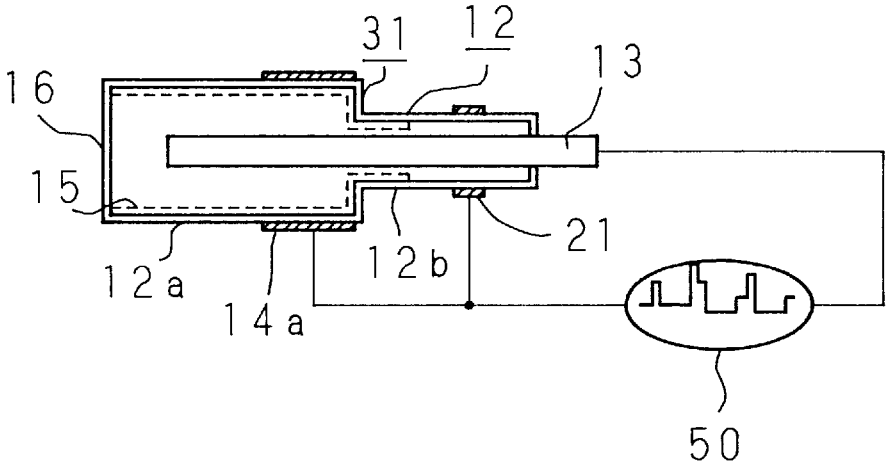
FIG. 16 is a diagram for showing a drive system of Embodiment 5.

At this point, as is shown in FIG. 16, the external electrode 21 is connected with the external electrode 14*a* disposed on the outer wall of the large-diameter portion 12*a*. In FIG. 16, the waveform of a drive signal for the fluorescent lamp of FIG. 15 is shown together with the structure of the fluorescent lamp. When this fluorescent lamp is driven by supplying a signal 50 (corresponding to the waveform X-Yi of FIG. 8), namely, by setting the peak value of the sustain pulse (XSP and YSP) to be equal to or larger than a value necessary for starting the auxiliary discharge (which naturally does not exceed a value necessary for starting the main discharge), the auxiliary discharge can be always caused. As a result, there is no need to provide a circuit for generating a signal for driving the external electrode 21.

Embodiment 6

Figure 17:
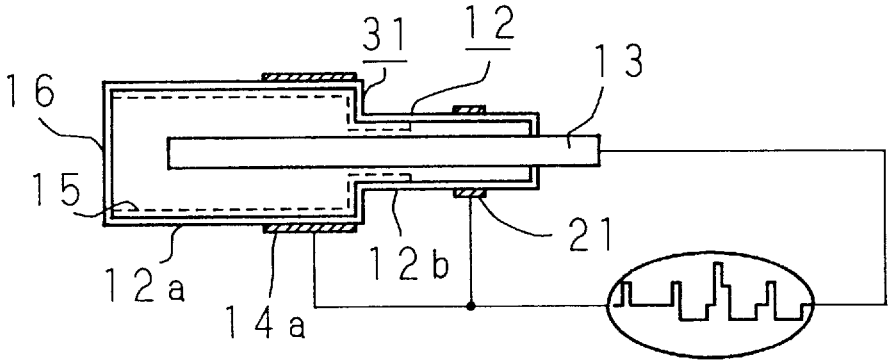
FIG. 17 is a diagram for showing a drive system of Embodiment 6.
Figure 18:
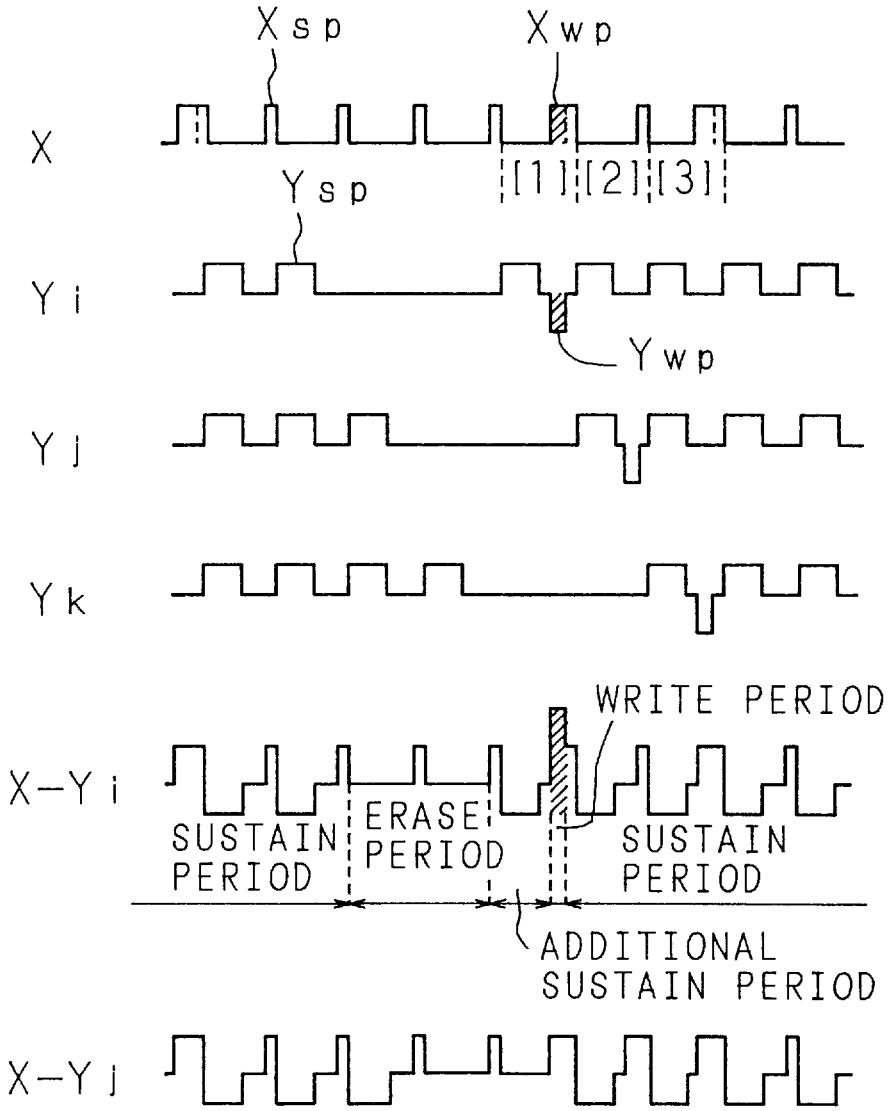
FIG. 18 shows waveforms of drive voltages used in the drive system of FIG. 17.

FIGS. 17 and 18 show still another embodiment of the invention using the fluorescent lamp 31 including the external electrode working as the third electrode. In the waveform shown in FIG. 18, one sustain signal 51 is inserted between an erase period and a subsequent write period.

When the signal 50 shown in FIG. 16 is used, not only the main discharge but also the auxiliary discharge are halted in an erase period. As a result, the auxiliary discharge is halted immediately before a write period, which spoils the effect of the auxiliary discharge by half. Therefore, by inserting the sustain signal 51, at least one auxiliary discharge is caused immediately before a write period. Thus, the main discharge call be easily caused.

Embodiment 7

Figure 19:
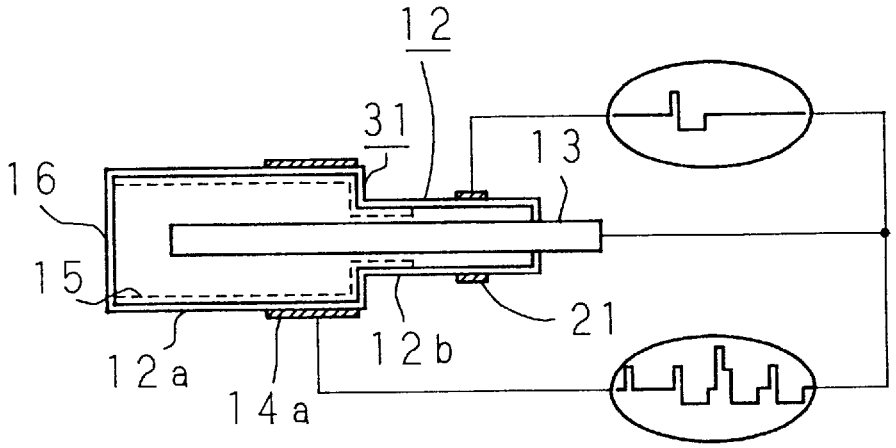
FIG. 19 is a diagram for showing a drive system of Embodiment 7.
Figure 20:
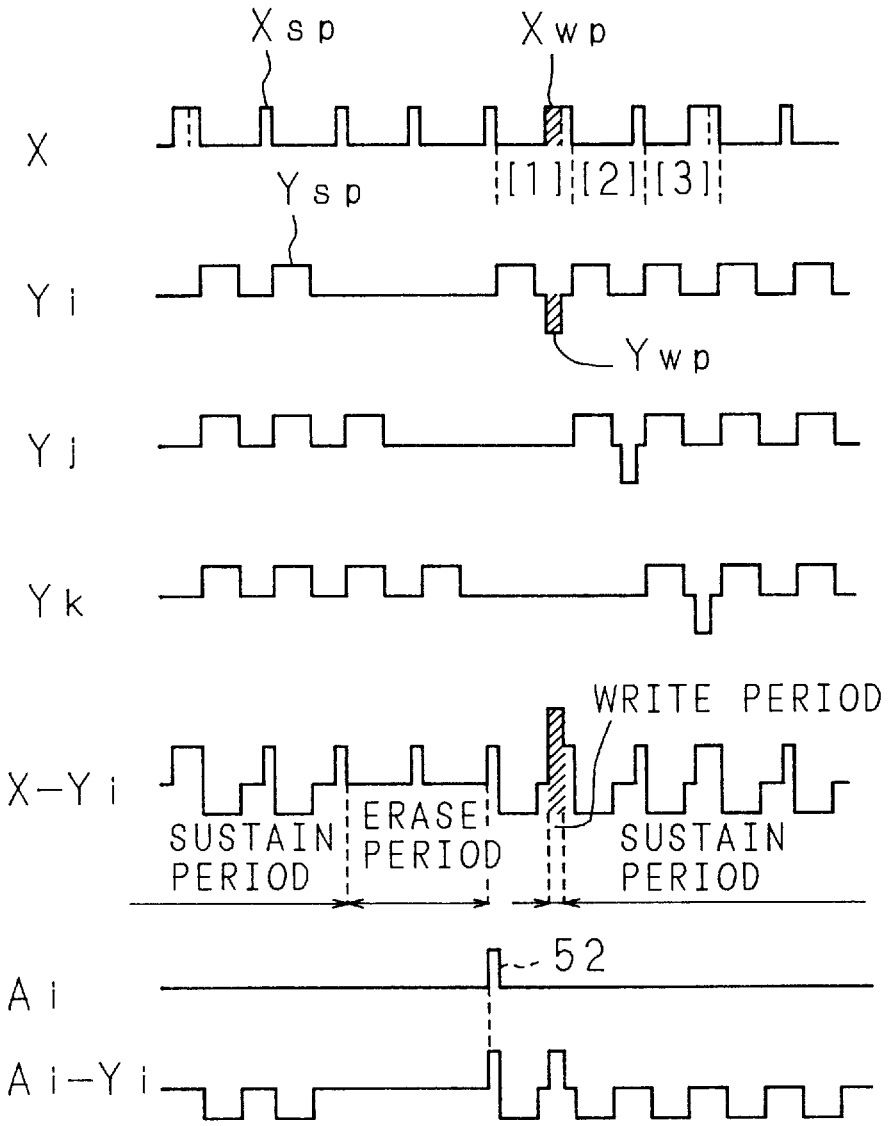
FIG. 20 shows waveforms of drive voltages used in the drive system of FIG. 19.

FIGS. 19 and 20 show still another embodiment of the invention using the fluorescent lamp 31 including the external electrode working as the third electrode. As is shown in FIG. 19, an auxiliary pulse 52 which is different from the signal supplied to the external electrode 11*a* and the internal electrode 13 is supplied to an external electrode 21, that is, the third electrode, disposed on the outer wall of the small-diameter portion and the internal electrode 13. In FIG. 20, the drive waveform of the auxiliary pulse 52 is shown as Ai. An auxiliary discharge is caused merely immediately before a write period by using the auxiliary pulse 52 applied to the external electrode 21. By causing the auxiliary discharge only immediately before the write period, the power consumed through the auxiliary discharge call be minimized, which can make contribution to decreasing the power consumption of the entire image display.

As described above, in the gas discharge image display of the invention, the peak value of a write signal applied to a column line (or a row line) for starting a discharge is substantially the same as the peak value of a sustain signal. As a result, the change of emission intensity caused by the other-line write operation can be effectively decreased.

Furthermore, since the polarities of a write signal and a sustain signal are made different, the matrix drive of the gas discharge image display can be attained.

Since the width of a write pulse is made larger than the width of a sustain pulse, discharge light emission can be stably sustained.

In addition, each fluorescent lamp is discharged to emit light by using all AC signal so that, after a rest period, the internal electrode working as the first electrode is first used as a negative electrode and the external electrode working as the second electrode is subsequently used as the negative electrode. Therefore, a sustain voltage can be effectively decreased.

Since the write operation is performed in the fluorescent lamp when the internal electrode is used as the negative electrode, the sustain voltage can be decreased.

Furthermore, the second and third electrodes provided on the outer wall of a cylindrical container are driven by using the same signal. As a result, the write operation can be stably performed.

At least one sustain signal is inserted between an erase signal for halting a discharge and a write signal subsequently following the erase signal. As a result, the write operation can be more stably performed.

Furthermore, the third electrode disposed on the outer wall of the cylindrical container is supplied with a drive signal merely immediately before a write signal. Therefore, power consumption can be decreased.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A gas discharge image display, comprising:

a plurality of discharge lamps, disposed in a matrix form, each having a characteristic of a predetermined discharge start voltage and including a dielectric cylindrical container in which a rare gas is sealed and first and second electrodes disposed on the cylindrical container, the discharge lamps forming row lines by mutually connecting the first electrodes of the discharge lamps disposed in a lateral direction of the matrix form and forming column lines by mutually connecting the second electrodes of the discharge lamps disposed in a longitudinal direction of the matrix form; and a row line drive circuit and a column line drive circuit connected with the row lines and the column lines, respectively, for applying pulse voltages to the row lines and the column lines, the row line drive circuit and the column line drive circuit simultaneously supplying write pulses having polarities reverse to each other to a row line and a column line to which a discharge lamp to be discharged is connected, so as to apply a voltage exceeding the discharge start voltage to the discharge lamp to be discharged, and the row line drive circuit and the column line drive circuit supplying sustain pulses to the row line and the column line at timing different from timing of supplying the write pulses, so as to apply a voltage lower than the discharge start voltage to the discharge lamp to be discharged, wherein a peak value of the write pulse supplied to one of the first and second electrodes is substantially equal to a peak value of the sustain pulse supplied to the electrode.

2. The gas discharge image display according to claim 1, wherein the first electrode is an internal electrode disposed within the cylindrical container of each discharge lamp, and the second electrode is an external electrode disposed on an outer wall of the cylindrical container.

3. The gas discharge image display according to claim 1, wherein the polarity of the write pulse supplied to at least one of the electrodes of the discharge lamp is reverse to the polarity of the sustain pulse supplied to the electrode to which the write pulse is applied.

4. The gas discharge image display according to claim 2, wherein the polarity of the write pulse supplied to at least one of the electrodes of the discharge lamp is reverse to the polarity of the sustain pulse supplied to the electrode to which the write pulse is applied.

5. The gas discharge image display according to claim 2, wherein a width of the write pulse supplied to at least one of the electrodes of the discharge lamp is larger than a width of the sustain pulse supplied to the electrode to which the write pulse is applied.

6. The gas discharge image display according to claim 2, wherein the write pulse and the sustain pulses have such polarities that the internal electrode first works as a negative electrode and the external electrode subsequently works as the negative electrode in each discharge lamp after a period when no voltage is applied by the row line drive circuit and the column line drive circuit.

7. The gas discharge image display according to claim 6, wherein the write pulses are supplied in a period when the internal electrode of the discharge lamp works as the negative electrode.

8. A gas discharge image display, comprising:

a plurality of discharge lamps, disposed in a matrix form, each having a characteristic of a predetermined discharge start voltage and including a dielectric cylindrical container which has different diameters in an axial direction and in which a rare gas is sealed, a first electrode disposed into the cylindrical container, and second and third electrodes disposed on outer walls of portions having the different diameters of the cylindrical container, the discharge lamps forming row lines by mutually connecting the first electrodes of the discharge lamps disposed in a lateral direction of the matrix form and forming column lines by mutually connecting the second electrodes of the discharge lamps disposed in a longitudinal direction of the matrix form, and the third electrode being connected with the second electrode in each discharge lamp; and a row line drive circuit and a column line drive circuit connected with the row lines and the column lines, respectively, for applying pulse voltages to the row lines and the column lines, the row line drive circuit and the column line drive circuit simultaneously supplying write pulses having polarities reverse to each other to a row line and a column line to which a discharge lamp to be discharged is connected, so as to apply a voltage exceeding the discharge start voltage to the discharge lamp to be discharged, and the row line drive circuit and the column line drive circuit supplying sustain pulses to the row line and the column line at timing different from timing of supplying the write pulses, so as to apply a voltage lower than the discharge start voltage to the discharge lamp to be discharged.

9. The gas discharge image display according to claim 8, wherein a peak value of the write pulse supplied to one of the first and second electrodes is substantially equal to a peak value of the sustain pulse supplied to the electrode.

10. The gas discharge image display according to claim 8, wherein at least one sustain pulse is supplied to each discharge lamp between an erase pulse for stopping a discharge and a write pulse subsequently following the erase pulse.

11. The gas discharge image display according to claim 9, wherein at least one sustain pulse is supplied to each discharge lamp between an erase pulse for stopping a discharge and a write pulse subsequently following the erase pulse.

12. A gas discharge image display, comprising:

a plurality of discharge lamps, disposed in a matrix form, each having a characteristic of a predetermined discharge start voltage and including a dielectric cylindrical container which has different diameters in an axial direction and in which a rare gas is sealed, a first electrode disposed into the cylindrical container, and second and third electrodes disposed on outer walls of portions having the different diameters of the cylindrical container, the discharge lamps forming row lines by mutually connecting the first electrodes of the discharge lamps disposed in a lateral direction of the matrix form and forming column lines by mutually connecting the second electrodes of the discharge lamps disposed in a longitudinal direction of the matrix form;

a row line drive circuit and a column line drive circuit connected with the row lines and the column lines, respectively, for applying pulse voltages to the row lines and the column lines, the row line drive circuit and the column line drive circuit simultaneously supplying write pulses having polarities reverse to each other to a row line and a column line to which a discharge lamp to be discharged is connected, so as to apply a voltage exceeding the discharge start voltage to the discharge lamp to be discharged, and the row line drive circuit and the column line drive circuit supplying sustain pulses to the row line and the column line at timing different from timing of supplying the write pulses, so as to apply a voltage lower than the discharge start voltage to the discharge lamp to be discharged; and a third electrode drive circuit for supplying the sustain pulse to the third electrode immediately before the write pulse.

13. The gas discharge image display according to claim 12, wherein a peak value of the write pulse supplied to one of the first and second electrodes is substantially equal to a peak value of the sustain pulse supplied to the electrode.

* * * * *